US005779555A

United States Patent [19]

Nomura et al.

[11] Patent Number: 5,779,555

[45] Date of Patent: Jul. 14, 1998

[54] SWING TYPE ATHLETIC EQUIPMENT AND PRACTICE APPARATUS THEREFOR

[75] Inventors: Kazuo Nomura; Kouji Fukuhisa; Yozo Ohara, all of Toyama-ken, Japan

[73] Assignee: Hokuriku Electric Industry Co., Ltd., Toyama Pref., Japan

[21] Appl. No.: 759,473

[22] Filed: Dec. 5, 1996

[30] Foreign Application Priority Data

Dec. 7, 1995 [JP] Japan ..... 7-319078
Nov. 20, 1996 [JP] Japan ..... 8-309138

[51] Int. Cl.[6] ..... A63B 69/36

[52] U.S. Cl. ..... 473/223

[58] Field of Search ..... 473/223, 224

[56] References Cited

U.S. PATENT DOCUMENTS 3,717,857 2/1973 Evans ..... 473/223 X
3,945,646 3/1976 Hammond ..... 473/223
5,365,799 11/1994 Okada ..... 73/862.041
5,441,269 8/1995 Henwood ..... 473/223 X

*Primary Examiner*—William H. Grieb
*Attorney, Agent, or Firm*—Rankin, Hill, Porter & Clark LLP

[57] ABSTRACT

A practice apparatus for a swing type athletic equipment capable of permitting a practicer to accurately know a locus of a ball hit. A triaxial acceleration sensor is mounted in a head of a golf club. Acceleration data in three detection-axis directions outputted from the triaxial acceleration sensor are transmitted to a data processing unit through a data transmission unit arranged in the grip. The data processing unit analyzes a locus of a golf ball hit and swing thereof based on the acceleration data. Results of the analysis are displayed on a monitor.

3 Claims, 5 Drawing Sheets

SWING TYPE ATHLETIC EQUIPMENT AND PRACTICE APPARATUS THEREFOR

BACKGROUND OF THE INVENTION

This invention relates to a swing type athletic equipment, and more particularly to a swing type athletic equipment such as golf club or the like and a practice apparatus therefor.

There has been conventionally known a practice apparatus for a swing type athletic equipment such as a golf club or the like which is adapted to estimate both a locus of an object hit such as a ball hit and a destination thereof without actually letting fly the ball far away. Such a conventional practice apparatus includes two position detection units arranged on a path along which a ball hit on the swing type athletic equipment travels or flies in a manner to be spaced from each other, so that a speed or velocity of the ball is obtained on the basis of both a distance between two positions detected by the position detection units and a length of time which the ball has spent to travel between the detection units and a direction of travel of the ball is obtained from two points through which the ball has traveled.

However, the position detection unit for detecting positions through which the ball passes requires a large number of sensors, resulting in being complicated in structure and increased in cost. Also, the conventional practice apparatus operates a locus of the ball on the basis of data obtained by measuring a position of the ball when it passes through each of the two position detection units. Unfortunately, this fails to judge whether or not the locus is curved. Further, the conventional swing type athletic equipment such as a golf club, a racket or the like permits a user or practicer to grasp a direction of travel of the ball and a locus thereof to a degree, however, it fails to permit the practicer to analyze a state of swing of the equipment by him.

SUMMARY OF THE INVENTION

The present invention has been made in view of the foregoing disadvantages of the prior art.

Accordingly, it is an object of the present invention to provide a practice apparatus for a swing type athletic equipment which is capable of more accurately providing a locus of an object hit such as a ball hit and a swing type athletic equipment which is suitable for use in such a practice apparatus.

It is another object of the present invention to provide a practice apparatus for a swing type athletic equipment which is capable of more accurately providing a locus of an object hit such as a ball hit while being relatively simplified in structure and a swing type athletic equipment which is suitable for use in such a practice apparatus.

It is a further object of the present invention to provide a practice apparatus for a swing type athletic equipment which is capable of transmitting data to a data processing unit without requiring to connect an obstructive communication line to the swing type athletic equipment.

It is still another object of the present invention to provide a practice apparatus for a swing type athletic equipment which is capable of analyzing a state of swing of the swing type athletic equipment by a practicer and a swing type athletic equipment which is suitable for use in such a practice apparatus.

It is yet another object of the present invention to provide a practice apparatus for a swing type athletic equipment which is capable of readily determining a direction of discharge of an object hit such as a ball hit.

It is a still further object of the present invention to provide a practice apparatus for a swing type athletic equipment which is capable of permitting a practicer to more accurately know a locus of a ball hit.

It is a yet further object of the present invention to provide a practice apparatus for a swing type athletic equipment which is capable of providing required data even when it is impossible to arrange a triaxial acceleration sensor in proximity to a hitting section of the swing type athletic equipment.

In accordance with one aspect of the present invention, a practice apparatus for a swing type athletic equipment including a grip and a hitting section which is directly or indirectly mounted on the grip and on which an object to be hit is hit is provided. The practice apparatus includes a triaxial acceleration sensor mounted on the swing type athletic equipment, a data processing unit for processing acceleration data in three detection-axis directions outputted from the triaxial acceleration sensor, and a display means for displaying results of processing by the data processing unit.

In a preferred embodiment of the present invention, the practice apparatus further includes a data transmission unit for transmitting the data outputted from the triaxial acceleration sensor to the data processing unit by wireless, wherein the data transmission unit is arranged in the grip.

Also, in accordance with this aspect of the present invention, a practice apparatus for a swing type athletic equipment including a grip and a hitting section which is directly or indirectly mounted on the grip and on which an object to be hit is hit. The practice apparatus includes a triaxial acceleration sensor mounted on the swing type athletic equipment, a discharge direction detection means for detection of a direction of discharge of the object hit, a data processing unit for processing acceleration data in three detection-axis directions outputted from the triaxial acceleration sensor and data outputted from the discharge direction detection means, and a display means for displaying results of processing by the data processing unit.

Further, in accordance with this aspect of the present invention, a practice apparatus for a golf club which includes a grip and a head mounted through a shaft on the grip is provided. The practice apparatus includes a triaxial acceleration sensor mounted on the head, a data processing unit for processing acceleration data in three detection-axis directions outputted from the triaxial acceleration sensor, a data transmission unit for transmitting the data outputted from the triaxial acceleration sensor to the data processing unit, and a display means for displaying results of processing by the data processing unit.

In a preferred embodiment of the present invention, the triaxial acceleration sensor is so arranged on the head that an extension line of one of detection axes thereof passes through a sweet spot of the head. The data processing unit analyzes swing of the golf club based on the acceleration data in the three detection-axis directions outputted from the triaxial acceleration sensor. The practice apparatus may further include a ball discharge direction detection means for detecting a direction of discharge of a golf ball hit, wherein the data processing unit operates a direction of discharge of the golf ball, rotation thereof and a flying distance thereof based on the acceleration data in the three detection-axis directions outputted from the triaxial acceleration sensor when the golf ball is hit by the golf club and data outputted from the ball discharge direction detection means, resulting in display data for displaying a locus of the ball on the display means being outputted to the display means depending on results of operation by the data processing unit.

In accordance with another aspect of the present invention, a swing type athletic equipment including a grip and a hitting section which is directly or indirectly mounted on the grip and on which an object to be hit is hit is provided. The swing type athletic equipment includes at least one triaxial acceleration sensor arranged in proximity to the hitting section for detecting components of acceleration in three detection-axis directions.

In a preferred embodiment of the present invention, the triaxial acceleration sensor is so arranged in the hitting section that an extension line of one of detection axes thereof passes through a sweet spot of the hitting section. Also, a plurality of the triaxial acceleration sensors are arranged so as to surround a sweet spot of the hitting section.

BRIEF DESCRIPTION OF THE DRAWINGS

These and other objects and many of the attendant advantages of the present invention will be readily appreciated as the same becomes better understood by reference to the following detailed description when considered in connection with the accompanying drawings; wherein.

DETAILED DESCRIPTION OF THE PREFERRED EMBODIMENTS

Now, the present invention will be detailedly described hereinafter with reference to the accompanying drawings.

Figure 1:
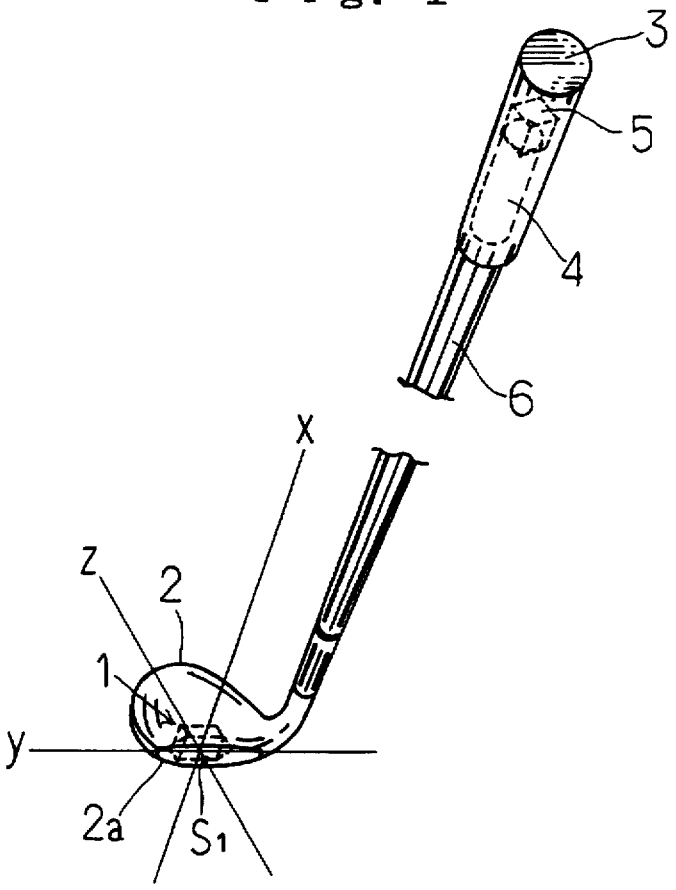
FIG. 1 is a partially cutaway perspective view showing a golf club suitable for use in an embodiment of a practice apparatus according to the present invention which takes the form of a golf practice apparatus.
Figure 3:
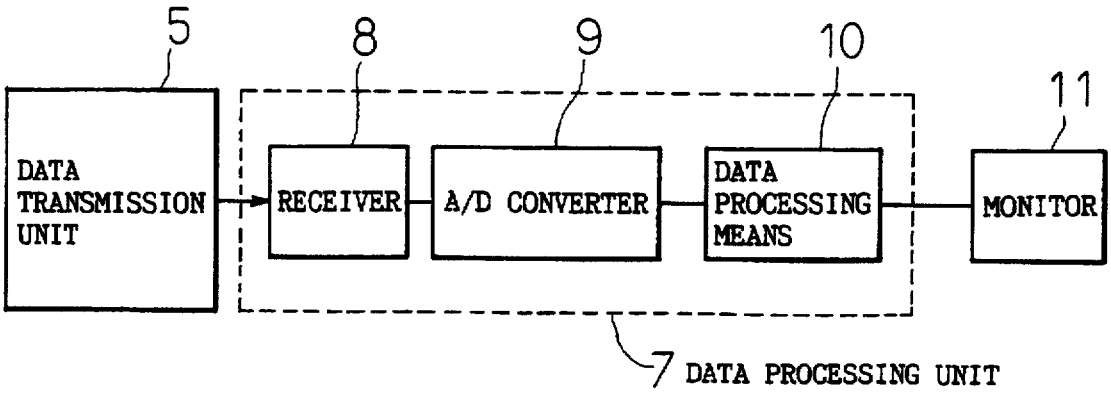
FIG. 3 is a schematic block diagram showing a structure of the golf practice apparatus shown in FIG. 1.

Referring first to FIG. 1, a swing type athletic equipment suitable for use in an embodiment of a practice apparatus according to the present invention is illustrated. In the illustrated embodiment, a practice apparatus is constructed in the form of a golf practice apparatus and a swing type athletic equipment is constructed in the form of a golf club. In the illustrated embodiment, the golf club includes a club head or hitting section 2 having a triaxial acceleration sensor 1 arranged therein. The triaxial acceleration sensor 1 is constructed so as to measure or detect a component of acceleration of force applied in a direction of each of three detection axes (X axis, Y axis and Z axis) thereof. In the illustrated embodiment, a commercially available triaxial acceleration sensor which Hokuriku Electric Industry Co., Ltd., Kami Niikawa-gun, Toyama-ken, Japan manufactures under a product number of HAG01 on the basis of a principle of a triaxial acceleration sensor, or a force sensor, disclosed in WO 93/02342 or U.S. Pat. No. 5,365,799 may be suitably used for this purpose.

Figure 2A:
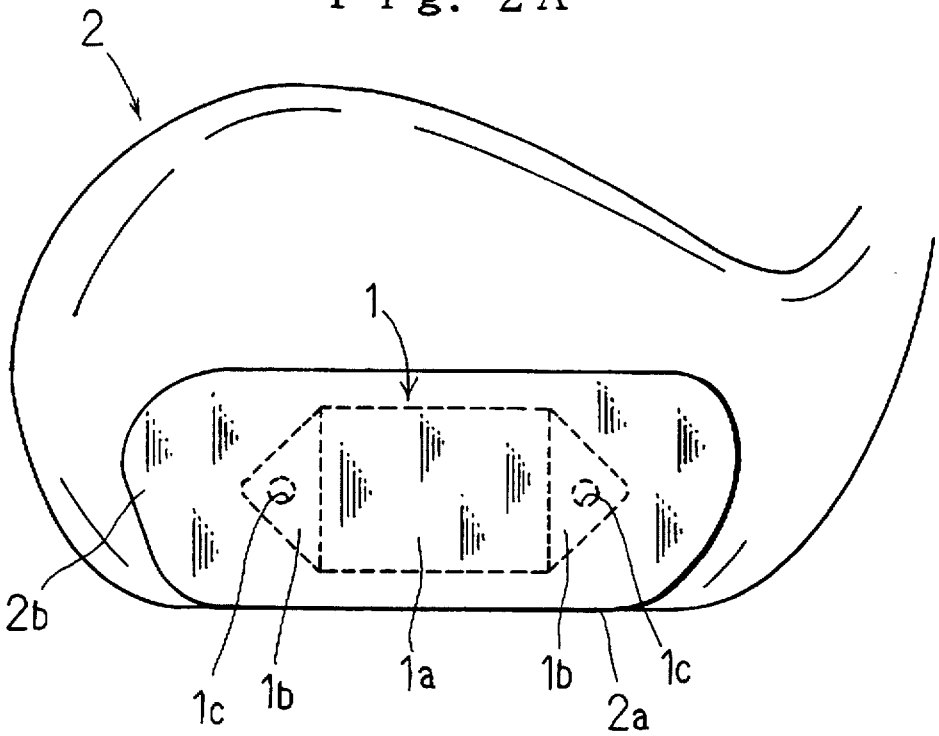
FIG. 2A is a schematic view showing a club head of the golf club shown in FIG. 1.
Figure 2B:
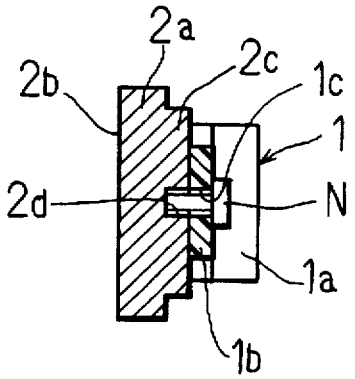
FIG. 2B is a vertical sectional view showing a triaxial acceleration sensor incorporated in the club head shown in FIG. 2A.

The triaxial acceleration sensor 1, as shown in FIGS. 2A and 2B, includes a sensor body 1*a* and a pair of sensor mounting sections 1*b*. The triaxial acceleration sensor 1 may be formed into dimensions of 35 mm×28 mm×15 mm. The sensor mounting sections 1*b* each are formed into a triangular shape and provided at a central portion thereof with a through-hole 1*c*.

The club head 2 includes a face 2*a*, which includes a front surface 2*b* and a rear surface opposite to the front surface 2*b*. The rear surface of the face 2*a* is formed with a face projection 2*c* in a manner to be integral with the face 2*a*. The face projection 2*c* is formed with two threaded holes 2*d*. The threaded holes 2*d* are formed so as to be aligned with the through-holes 1*c* of the triaxial acceleration sensor 1, respectively. Thus, the triaxial acceleration sensor 1 is fixed on the face 2*a* of the club head 2 by means of a screw N inserted through each of the through-holes 1*c*. Joining of the triaxial acceleration sensor 1 to the face 2*a* by means of an adhesive may fail to permit the triaxial acceleration sensor 1 to accurately measure acceleration due to elasticity exhibited by the adhesive. On the contrary, joining of the triaxial acceleration sensor 1 to the face 2*a* by means of the screws N eliminates such a problem.

The triaxial acceleration sensor 1 is constructed so as to output acceleration data in three detection-axis directions of the golf club including an X-axis direction, a Y-axis direction and a Z-axis direction through three lead wires, respectively. In the illustrated embodiment, the triaxial acceleration sensor 1 is arranged in the club head 2 in such a manner that an extension of a Z axis which is one of three detection axes thereof passes through a sweet spot S1 on the face 2*a* of the club head 2. Such arrangement of the triaxial acceleration sensor 1 permits the triaxial acceleration sensor 1 to accurately determine whether or not a golf ball has been hit on the sweet spot and effectively grasp a locus of the golf ball hit.

The golf club also includes a grip 3, in which a battery 4 and a data transmission unit 5 are arranged. The triaxial acceleration sensor 1 is electrically connected to the battery 4 and data transmission unit 5 through lead wires arranged in a shaft 6 so as to extend therethrough. The shaft 6 may be made of a metal material or the like. The battery 4 acts to feed the triaxial acceleration sensor 1 and data transmission unit 5 with an electric power. In the illustrated embodiment, the triaxial acceleration sensor 1 may be suitably constructed so that a consumption power thereof is reduced to a level as low as 2.5 mW. Thus, a dry cell may be conveniently used as the battery 4 while minimizing frequency in exchange thereof. Alternatively, a rechargeable secondary battery may be substituted such a dry cell. In this instance, an oscillatory generation element is received in the club head 2, so that an output of the element may be used for recharging the battery 4.

The data transmission unit 5 may comprise a wireless transmitter for modulating three acceleration data in the X-axis, Y-axis and Z-axis directions for wireless or radio transmission. For this purpose, in the illustrated embodiment, the metal shaft 6 functions as an antenna for the wireless transmitter. When the shaft 6 is made of a carbon material, a linear antenna wire may be attached to a surface of the shaft 6 so as to extend in a longitudinal direction thereof. Alternatively, a flexible antenna wire may be arranged on the grip 3 so as to outwardly extend therefrom. Wireless transmission of the data permits swing of the golf club to be carried out without any obstruction by a wire.

The acceleration data transmitted from the data transmission unit 5 by wireless are received by a receiver 8 of a data processing unit 7. The receiver 8 acts to demodulate three acceleration data in the X-axis, Y-axis and Z-axis directions from the data transmitted thereto by wireless. Three such acceleration data thus demodulated each are converted into a digital signal by an A/D converter 9 and then processed by a data processing means 10. The data processing means 10 has a microcomputer incorporated therein which acts as an operation means. Thus, the data processing means 10 subjects the acceleration data to analysis and operation according to a data processing program, to thereby carry out data processing required. Results of the data processing are displayed in the form of figures, letters or the like on a monitor 11 acting as a display means. This results in obtaining data on acceleration of the golf club both during swing thereof and at the time of impact thereof, so that resultant or synthesized acceleration applied from the golf club to a ball may be calculated. Also, integration of each of the data provides a speed or velocity of the ball in each of the directions. Further, integration of each data twice permits provides a travel or flying distance of the ball in each of the directions. Thus, it will be noted that the data processing unit 7 carries out processing of the data to provide a velocity of shooting or discharge of a ball hit or impacted by the golf club, a locus thereof and a flying distance thereof.

More specifically, the golf practice apparatus of the illustrated embodiment provides an angle of each of inclination and opening of the face 2*a* of the club head 2 at the time of impact thereof, a position on the face 2*a* of the golf club 2 on which a golf ball is hit and a direction of shooting or discharge of the ball hit through the above-described operation by the data processing unit based on the acceleration data in the three detection-axis directions outputted from the triaxial acceleration sensor 1 during swing of the golf club and at the time of impact thereof. Ideal swing of the golf club permits only acceleration components in only the Z-axis direction and Y-axis direction to be obtained immediately before the impact. Therefore, an acceleration component in the X-axis direction just before the impact acts as data for providing an angle of inclination between the face and a vertical plane passing through a point of contact of the face with the golf ball. Also, an angle of opening of the face indicated at θ in FIG. 4A may be obtained by an operation based on both data on a direction of advance of the club head 2 obtained from the acceleration data and a variation in acceleration at the time of impact.

Figure 4A:
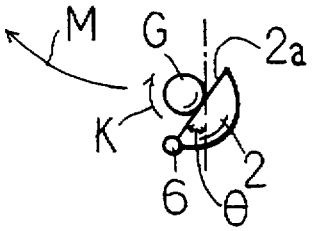
FIGS. 4A to 4C each are a schematic view showing an angle of a face of the club head of the golf club shown in FIG. 2A.
Figure 4B:
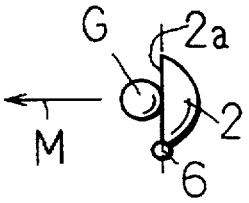
Figure 4C:
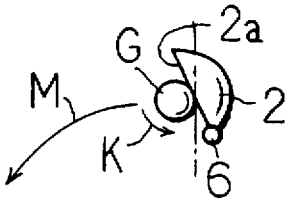

In particular, the opening angle θ of the club face 2*a* permits a direction of rotation of the golf ball G indicated at an arrow K and a rotational speed thereof to be provided. More specifically, as shown in FIGS. 4A to 4C, the opening angle θ of the face 2*a* of the club head 2 at the time of impact thereof is measured on the basis of the acceleration data in the three direction-axis directions. The angle θ is defined to be an angle between a line extending from a user of the apparatus or a practicer indicated at broken lines to the golf ball G and the face 2*a*. Then, an angular moment applied to the golf ball G is obtained on the basis of the opening angle of the face 2*a* and the acceleration data in the three detection-axis directions. Thus, the illustrated embodiment provides information or data on any curve occurring in a flying locus of the golf ball G indicated at an arrow M in FIGS. 4A and 4C.

One output of the triaxial acceleration sensor is insufficient to specify a direction of shooting or discharge of the golf ball. Thus, dummy swing of the golf club is carried out as slowly and accurately as possible, so that a direction of a maximum value of acceleration of the golf club obtained by the dummy swing is specified as a direction of a target destination of the golf ball. Thus, the direction of discharge of the golf ball may be determined depending on both data on the target designation direction thus previously specified and data obtained during the practice.

Figure 5:
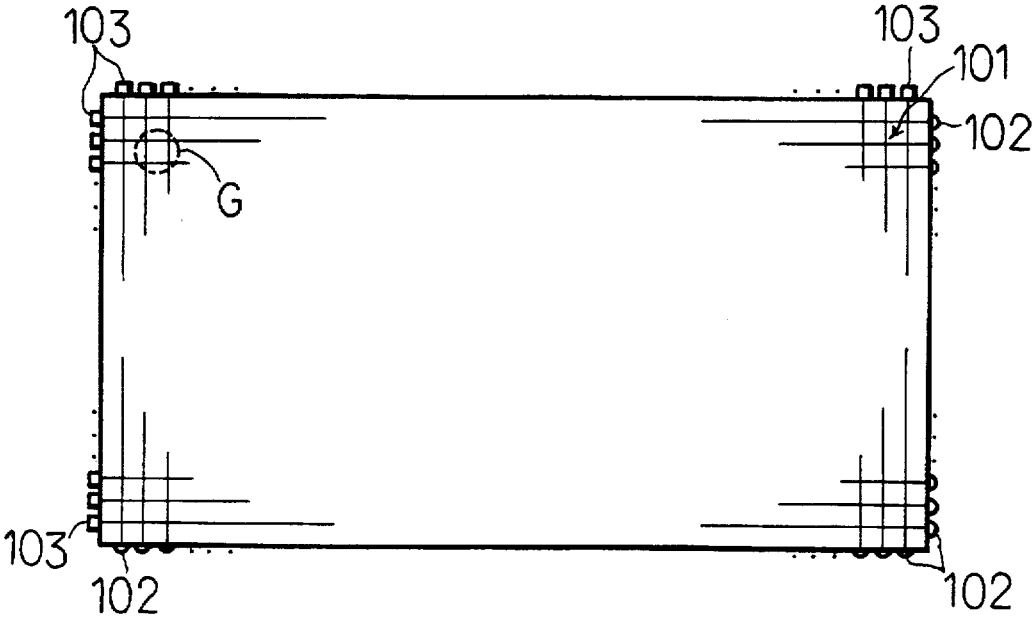
FIG. 5 is a schematic view showing a ball discharge direction detection means for detecting a direction of shooting or discharge of a golf ball hit which is incorporated in the golf practice apparatus shown in FIG. 1.

Alternatively, a ball discharge direction detection means for detecting such a direction of discharge of the golf ball hit may be separately provided. In this instance, both a signal fed from the ball discharge direction detection means and a signal from the triaxial acceleration sensor 1 are processed by the data processing unit 7, so that a destination of the golf ball hit may be known or determined. Such a ball discharge direction detection means, as shown in FIG. 5, may include a plurality of light emitters 102 arranged on a side of discharge of the golf ball for forming a light matrix 101 having a mesh of a size smaller than the golf ball indicated at broken lines G and a plurality of light receptors 103 each acting to detect light emitted from each of the light emitters 102. In the ball discharge direction detection means thus constructed, passing of the golf ball through the matrix 101 permits light forming the matrix 101 to be partially intercepted, so that a position on the matrix 101 through which the golf ball passes may be detected. This results in the direction of discharge of the golf ball being accurately detected.

Figure 6A:
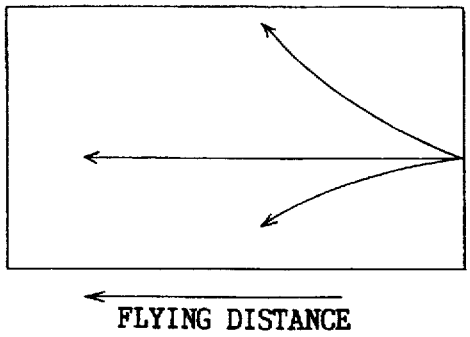
FIGS. 6A and 6B each are a graphical representation showing a locus of a golf ball hit which is displayed on the golf practice apparatus shown in FIG. 1.
Figure 6B:
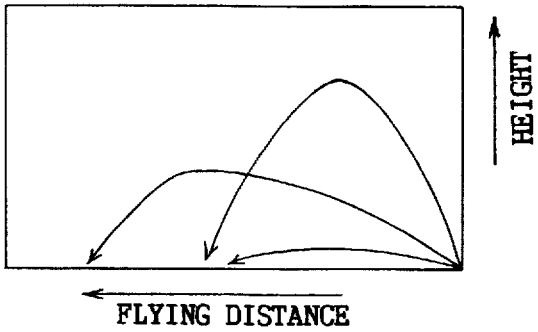

The above-described construction of the illustrated embodiment permits the data processing unit 10 to operate an angle of the face 2*a* of the club head 2 at the time of impact thereof, a position on the face 2*a* on which the golf ball is hit or impacted, and a direction of discharge of the golf ball. Then, such results of the operation permit a locus of the golf ball to be displayed on the monitor 11 as shown in FIGS. 6A and 6B, wherein FIG. 6A shows a locus of the ball viewed in a downward direction and FIG. 6B shows that viewed in a lateral direction.

Figure 7:
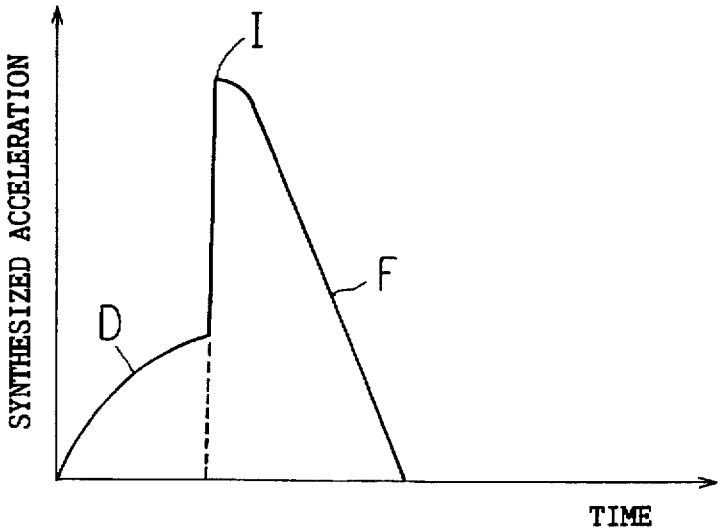
FIG. 7 is a graphical representation showing relationship between time and resultant or synthesized acceleration obtained by synthesizing vectors in three detection-axis directions which are detected by a triaxial acceleration sensor.

In addition, the triaxial acceleration sensor 1 incorporated in the golf practice apparatus of the illustrated embodiment permits a component of acceleration of the golf club in each of the three detection-axis directions to be detected during swing of the golf club, so that the swing may be analyzed as well. FIG. 7 shows relationship between time and resultant or synthesized acceleration of the golf club obtained by synthesizing vectors in the three detection-axis directions or X-axis, Y-axis and Z-axis directions detected by the triaxial acceleration sensor 1. In FIG. 7, D indicates a variation in synthesized acceleration at the time of down-swing of the golf club, I indicates synthesized acceleration of the golf club during impact thereof, and F indicates a variation in synthesized acceleration during follow-through of the golf club. Such data are used for provide a variation in synthesized acceleration during swing of the golf club. Then, a circular orbit of the golf club is monitored, to thereby know whether or not the golf club is subject to normal or correct rotation.

Further, the golf practice apparatus of the illustrated embodiment may be used for obtaining data of a skilled golfer. Then, comparison between the thus obtained data and data on any golf practicer using the practice apparatus permits the practicer to grasp a degree of progress by self-diagnosis. Also, comparison between stored past data of a practicer and his current data likewise permits him to know a degree of progress by self-diagnosis.

In the illustrated embodiment, transmission of output data of the triaxial acceleration sensor 1 to the data processing unit 10 is carried out by wireless. Alternatively, it may be carried out through wire or optical transmission.

Actually, any accidental or unexpected shaking of the golf club before swing thereof for hitting a golf ball causes the practice apparatus of the illustrated embodiment to detect acceleration thereof during the shaking. In order to obtain required data while eliminating adverse affection of the shaking, an approach may be employed which is so constructed that the grip 3 is provided with a push switch and the data transmission unit 5 is provided therein a circuit for outputting a switch start signal by which the push switch is operated when the swing is started, resulting in data on the acceleration being transmitted together with the swing start signal. The data processing unit 7 carries out analysis based on data within a predetermined period of time after generation of the swing start signal. This eliminates analysis of unnecessary data. Also, as will be noted from FIG. 7, the synthesized acceleration is substantially increased at the time of impact of the golf club against a golf ball, so that a moment of the impact may be detected on the basis of the data, resulting in only predetermined data before and after the impact being analyzed.

The data processing unit may be arranged inside or outside the swing-type athletic equipment. Alternatively, any suitable optical transmission utilizing laser or the like may be substituted for the wireless transmission, wherein light emitters are mounted on the swing type athletic equipment and light receptors are arranged around a place in which swing of the swing type athletic equipment takes place.

Further, a semiconductor memory may be removably received in the swing type athletic equipment so that an output of the triaxial acceleration sensor 1 is stored in the semiconductor memory. In this instance, the semiconductor memory is removed from the swing type athletic equipment after swing of the athletic equipment and then data stored in the memory are read therefrom by means of the data processing unit 10.

Figure 8:
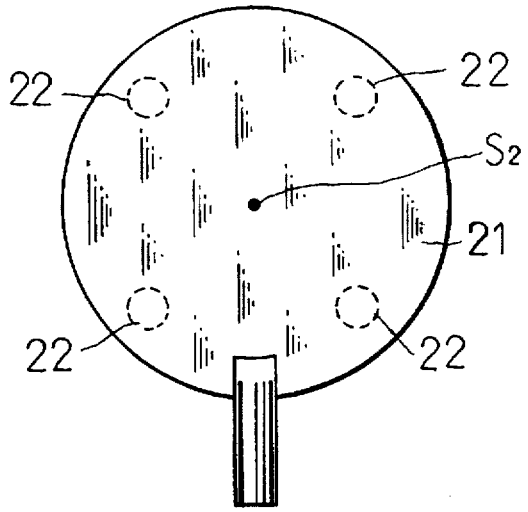
FIG. 8 is a plan view showing a table tennis paddle suitable for use in another embodiment of a practice apparatus according to the present invention which is in the form of a table tennis practice apparatus.
Figure 9:
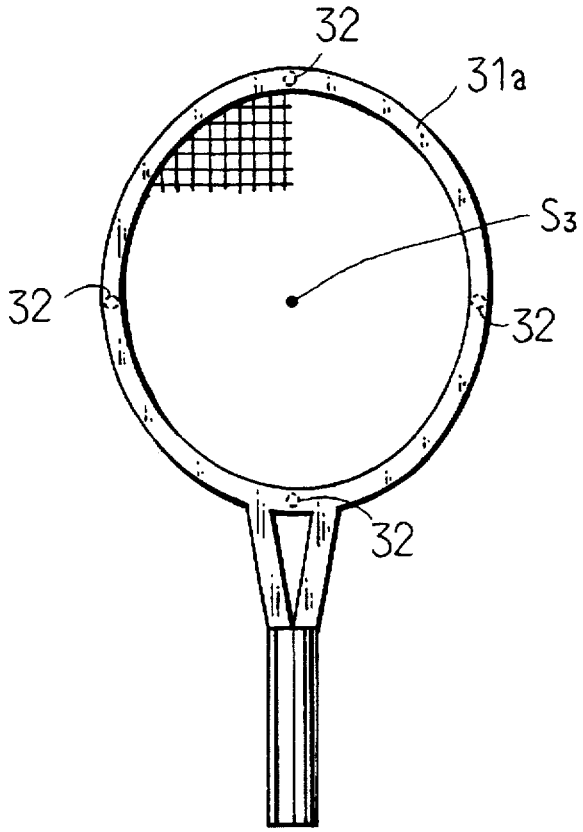
FIG. 9 is a plan view showing a tennis racket suitable for use in a further embodiment of a practice apparatus according to the present invention which is in the form of a tennis practice apparatus.

The above description has been made in connection with the golf practice apparatus. However, the present invention may be applied to a practice apparatus for a swing type athletic equipment which is constructed in any other form. For example, when the present invention is applied to a batting practice apparatus for baseball, the triaxial acceleration sensor 1 may be embedded in a bat. Also, when the triaxial acceleration sensor cannot be arranged so as to permit an extension line of the detection axis to pass through a sweet spot of a hitting portion of a head of an athletic equipment as in a table tennis racket or a table tennis racket, a plurality of such triaxial acceleration sensors may be arranged so as to surround the sweet spot. For example, when the present invention is applied to a table tennis practice apparatus, it may be constructed in such a manner as shown in FIG. 8. More particularly, a plurality of triaxial acceleration sensors 22 are mounted on a hitting portion 21 of a tennis racket paddle so as to surround a sweet spot S2 of the hitting portion 21. Also, application of the present invention to a tennis practice apparatus may be carried out as shown in FIG. 9. Thus, a plurality of triaxial acceleration sensors 32 are arranged on a frame 31*a* of a tennis racket so as to surround a sweet spot of a hitting portion 31 of the racket. When the present invention is applied to a batting, tennis or table tennis practice apparatus, the apparatus is often required to hit a ball coming running. Thus, the data processing unit may have data on a speed of a ball coming running, rotation thereof and the like previously stored therein.

As can be seen from the foregoing, the present invention is so constructed that the swing type athletic equipment is mounted with the triaxial acceleration sensor, resulting in obtaining data on acceleration of force applied to the triaxial acceleration sensor in the three detection-axis directions. Thus, the present invention permits a locus of a ball hit or the like to be accurately operated and displayed, so that a practice apparatus for a swing type athletic equipment may be manufactured with ease and at a reduced cost.

Also, processing of acceleration data in the three direction-axis directions by means of the data processing unit permits a practicer to accurately know a locus of an object hit as compared with the prior art. Further, the practice apparatus of the present invention can detect acceleration components in the three detection-axis directions during swing of the swing type athletic equipment by a practicer, resulting in the swing being effectively analyzed.

While preferred embodiments of the invention have been described with a certain degree of particularity with reference to the accompanying drawings, obvious modifications and variations are possible in light of the above teachings. It is therefore to be understood that within the scope of the appended claims, the invention may be practiced otherwise than as specifically described.

What is claimed is:

1. A practice apparatus for a golf club including a grip and a head mounted through a shaft on said grip, comprising:

a triaxial acceleration sensor mounted on said head;

a ball discharge direction detection means for detecting a direction of discharge of a golf ball hit;

a data processing unit, for processing acceleration data in three detection-axis directions outputted from said triaxial acceleration sensor and for processing data outputted from said ball discharge direction detection means, to determine the direction of discharge of the golf ball, rotation thereof and the flying distance thereof resulting in display data representing the locus of the golf ball;

a data transmission unit for transmitting the data outputted from said triaxial acceleration sensor and the data outputted from said ball discharge direction detecting means to said data processing unit; and a display means for displaying the locus of the golf ball in response to the display data received from said data processing unit.

2. A practice apparatus as defined in claim 1, wherein said triaxial acceleration sensor is so arranged on said head that an extension line of one of detection axes thereof passes through a sweet spot of said head.

3. A practice apparatus as defined in claim 1, wherein said data processing unit analyzes swing of the golf club based on said acceleration data in the three detection-axis directions outputted from said triaxial acceleration sensor.

* * * * *